US007258253B2

(12) United States Patent
Nicol et al.

(10) Patent No.: US 7,258,253 B2
(45) Date of Patent: Aug. 21, 2007

(54) METHOD AND SYSTEM FOR PRECISE DISPENSATION OF A LIQUID

(75) Inventors: David Nicol, Anaheim, CA (US); Binh Nguyen, San Diego, CA (US); Peter J. Coassin, Encinitas, CA (US)

(73) Assignee: Aurora Discovery, Inc., San Diego, CA (US)

( * ) Notice: Subject to any disclaimer, the term of this patent is extended or adjusted under 35 U.S.C. 154(b) by 332 days.

(21) Appl. No.: 10/837,221

(22) Filed: Apr. 30, 2004

(65) Prior Publication Data

US 2005/0006417 A1 Jan. 13, 2005

Related U.S. Application Data

(60) Provisional application No. 60/467,062, filed on Apr. 30, 2003.

(51) Int. Cl.
*B67D 5/08* (2006.01)

(52) U.S. Cl. ..... 222/420; 222/215; 239/102.1; 239/102.2

(58) Field of Classification Search ..... 222/420, 222/215, 189.11, 189.06; 239/102.1, 102.2; 604/295, 299; D24/112
See application file for complete search history.

(56) References Cited

U.S. PATENT DOCUMENTS 3,683,212 A 8/1972 Zoltan ..... 310/328
3,946,398 A 3/1976 Kyser et al. ..... 347/70
4,418,354 A * 11/1983 Perduijn ..... 347/68
4,418,356 A * 11/1983 Reece ..... 347/40
4,518,974 A * 5/1985 Isayama ..... 347/92
4,528,579 A * 7/1985 Brescia ..... 347/94
4,834,637 A * 5/1989 Conta et al. ..... 425/110
4,877,745 A 10/1989 Hayes et al. ..... 436/166
4,925,065 A * 5/1990 Golias ..... 222/189.06
5,139,174 A * 8/1992 Golias ..... 222/189.11
5,388,925 A 2/1995 Wilcox et al. ..... 401/261
6,232,129 B1 * 5/2001 Wiktor ..... 436/180
6,296,811 B1 * 10/2001 Sasaki ..... 422/100
6,521,187 B1 * 2/2003 Papen ..... 422/100

* cited by examiner

*Primary Examiner*—Patrick Brinson
(74) *Attorney, Agent, or Firm*—DLA Piper Rudnick Gray Cary US LLP

(57) ABSTRACT

Devices, systems, and methods for the precise dispensation of small volumes of liquids are presented. A fluid microdispenser comprises a liquid-filled tube, an actuator coupled to the tube, and a tip at one end of the tube. When the actuator applies an actuation pressure, a precise volume of liquid is ejected from the orifice of the tip. The orifice is manufactured to control the volume of liquid ejected by each actuation and, therefore, may have a diameter smaller than that of the liquid-filled tube. The invention comprises systems, methods, and devices so that the inner diameter of the liquid-filled tube is decreased (tapered) to that of the orifice so as to maximize transmission to the orifice of the pressure generated by the actuation stimulus. This enables the volume of liquid ejected by each stimulus to be reproducibly controlled by the amplitude of the actuation stimulus.

43 Claims, 6 Drawing Sheets

PLASTIC TIP SECTION DETAIL

TIP ORIFICE DETAIL

FLUID RESERVOIR
TO TIP TRANSITION

METHOD AND SYSTEM FOR PRECISE DISPENSATION OF A LIQUID

RELATED APPLICATION DATA

This application claims the benefit of U.S. Provisional Application No. 60/467,062, filed Apr. 30, 2003, and titled, FLUID MICRODISPENSER DISCHARGE ORIFICE, the contents of which are incorporated by reference in their entirety.

BACKGROUND OF THE INVENTION

1. Field of the Invention

This invention relates in general to the controlled dispensing of small volumes of liquid, and more particularly, to precisely metering the volume of liquid dispensed by a fluid microdispenser. Even more particularly, this invention relates to reproducibly controlling sub-nanoliter liquid drop size in a fluid microdispenser.

2. Description of the Related Art

Dispensing liquid volumes of less than 1 nanoliter accurately and reproducibly in a single drop is a long-sought goal in areas as diverse as chemical screening for drug discovery, pharmaceutical formulation, agricultural chemistry, cosmetic and food processing, and ink-jet printing. In drug discovery, for example, small quantities of chemical substances dissolved in liquid at large concentration are distributed to a large number of reaction wells each with a volume capacity of 1 μl, in which a biological assay is replicated many times. These concentrates include test chemical compounds with unknown biochemical or physiological effects in which it is desired to construct many reactions with the same concentration of the test chemical compound in each reaction.

Precise metering is also useful in analytical chemistry to distribute small quantities of concentrates of fluorimetric or radiometric indicator compounds used to measure the rate and extent of a chemical, biochemical, or physiological reaction. In cell culture, it is desired to deliver small quantities of valuable biological reagents necessary for the survival of cells or tissue explants cultured to provide a platform for biological assays. In large-format automated arrays of liquid dispensers in which the intrinsic drop volume is different from dispenser to dispenser, it is desirable to adjust the drop volume delivered by each dispenser so that all dispensers are "tuned" to deliver droplets of identical or nearly identical volume.

In all these applications, the crucial demand is delivery of sub-nanoliter liquid drops in which the volume of each drop is identical (or nearly so) and can be adjusted to the needs of the application. Many designs for dispensers have been utilized for producing sub-nanoliter-volume drops. In many circumstances, a piezoelectric actuator is coupled to a liquid filled tube that contains a circular orifice at one end from which liquid drops are ejected. When the piezoelectric material is actuated by an electrical voltage pulse, the piezoelectric material increases in thickness and compresses the liquid-filled tube by decreasing its volume. This compression induces a pressure increase in the liquid that travels throughout the interior of the tube to the liquid-vapor interface that spans the orifice at the dispensing end of the tube. If the magnitude of the pressure is sufficient to overcome the forces that limit the formation of a liquid drop, such as the interfacial tension required to increase the area of liquid surface in contact with air, the viscous drag of pressure-driven liquid movement, and the inertia inherent in causing a mass of liquid to move, then a liquid drop is ejected from the orifice. Such systems are described in U.S. Pat. No. 3,683,212 to Zoltan, U.S. Pat. No. 3,946,398 to Kyser et al, and U.S. Pat. No. 4,877,745 to Hayes et al, which are hereby incorporated herein by reference in their entirety.

These methods of liquid dispensation involve several complications. Firstly, there are several modes of drop formation. When the piezoelectric element is actuated with a voltage pulse of low amplitude, drop formation is intermittent, in that not every actuation pulse elicits ejection of a single drop. Identically sized pulses may elicit drops with different volumes. With an actuation pulse of large amplitude, a large volume of liquid may be ejected from the orifice, resulting in the formation of multiple drops for each pulse (such as satellites). These drops may have different trajectories, resulting in the possibility that some of the ejected liquid may miss its desired target. In between these small and large actuation pulse amplitudes is a range over which each pulse elicits dispensing of a single drop that is identical upon each actuation. As the pulse amplitude is increased or decreased, the volume of the ejected drop is increased or decreased in proportion. This uniform mode of dispensing is most desired when it is imperative to deliver a fixed quantity of liquid to the same location on each actuation.

A further complication with these systems is the shape of the lumen of the fluid reservoir. The choice of fluid reservoir lumen diameter is determined by many factors. These factors may include the need for a low hydraulic resistance to facilitate the movement of system fluid and sample liquid into and out of the fluid reservoir for washing as well as the expense and ability to create a lumen of desired uniform diameter and smoothness. In addition, a larger lumen will prevent obstruction by the aggregation of solid or colloidal material that may be present in the sample. The diameter of the orifice, however, is selected on the basis of the desired drop volume, which usually scales as volume–$(\text{diameter})^3$ (Hayes et al). Therefore, to eject drops with volumes on the order of less than 1 nl requires an orifice diameter less than 100 μm. Since lumenal diameters of the fluid reservoir may approach 1 mm or greater, there is often a mismatch in diameter of the components in the pathway along which the actuation pressure is transmitted.

The way that this mismatch is accommodated in a dispenser may determine the effectiveness of the actuation pulse. For example, in the piezo dispensers of Bogy and Talke and Zoltan, the orifice was drilled through a plate that was then cemented over one end of a 1 mm-diameter tube reservoir. These dispensers required voltage pulses across the piezoelectric elements in excess of 300 V to actuate drop ejection. Other methods to create a taper in the lumen of the tube include heating a small region of a glass tube and then drawing the tube so that the lumen narrows to the necessary orifice diameter. However, this type of heating-pulling method may result in a variable change in radius as a function of longitudinal distance down the tube as the orifice is approached, so that each drawn tube may have a different taper shape and hence, different dispensing characteristics.

The taper shape in turn influences the hydrodynamic mechanism of the pump. To form a nozzle, the tube lumen narrows and terminates as an orifice of diameter less than the diameter of the tube lumen in its straight portion. Where the tube radius begins to decrease, the fluid stream turns toward the nozzle. Restriction to flow in the longitudinal direction creates flow in the radial direction due to the buildup of a pressure gradient in the radial direction. This radial gradient of pressure has the effect of decreasing the longitudinally directed pressure gradient. If the longitudinal pressure gradient is decreased too much, then it will be insufficient to push enough liquid out the orifice to create a drop.

SUMMARY OF THE INVENTION

Devices, systems, and methods are disclosed which reproducibly meter the precise volume of drops ejected by a microfluid dispenser. In many embodiments, a tip is utilized for the dispensation of the liquid, the tip contains an orifice, a first region that accommodates a discharge end of a fluid reservoir, and a second region between the first region and the orifice. The second region tapers to the orifice at an angle that maximizes the longitudinal component of the actuation pressure at the orifice.

Additionally, systems and methods are presented which utilize tips of this type to precisely meter the dispensation of liquid from a fluid microdispenser.

In some embodiments, the first region is cylindrically shaped and the discharge end of the fluid reservoir is cylindrically shaped, the inner diameter of the first region is greater than the outer diameter of the discharge end of the fluid reservoir and the first region has a nib to secure the tip to the discharge end of the fluid reservoir.

In other embodiments, these types of tips are used with a fluid reservoir and an actuator to precisely meter the volume of a dispensed liquid.

These, and other, aspects of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore nonlimiting, embodiments illustrated in the drawings, wherein identical reference numerals designate the same components. The invention may be better understood by reference to one or more of these drawings in combination with the description presented herein. It should be noted that the features illustrated in the drawings are not necessarily drawn to scale.

DESCRIPTION OF PREFERRED EMBODIMENTS

The invention and the various features and advantageous details thereof are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Attention is now directed to devices, systems, and methods for precisely controlling the volume of a dispensed liquid. The liquid is passed through a tip which is optimally shaped to pass an actuation pressure to the orifice of the tip. It will be understood by those skilled in the art that the same devices, systems, and methods can be used to create desired dispensing characteristics for a variety of liquids and applications.

Figure 1:
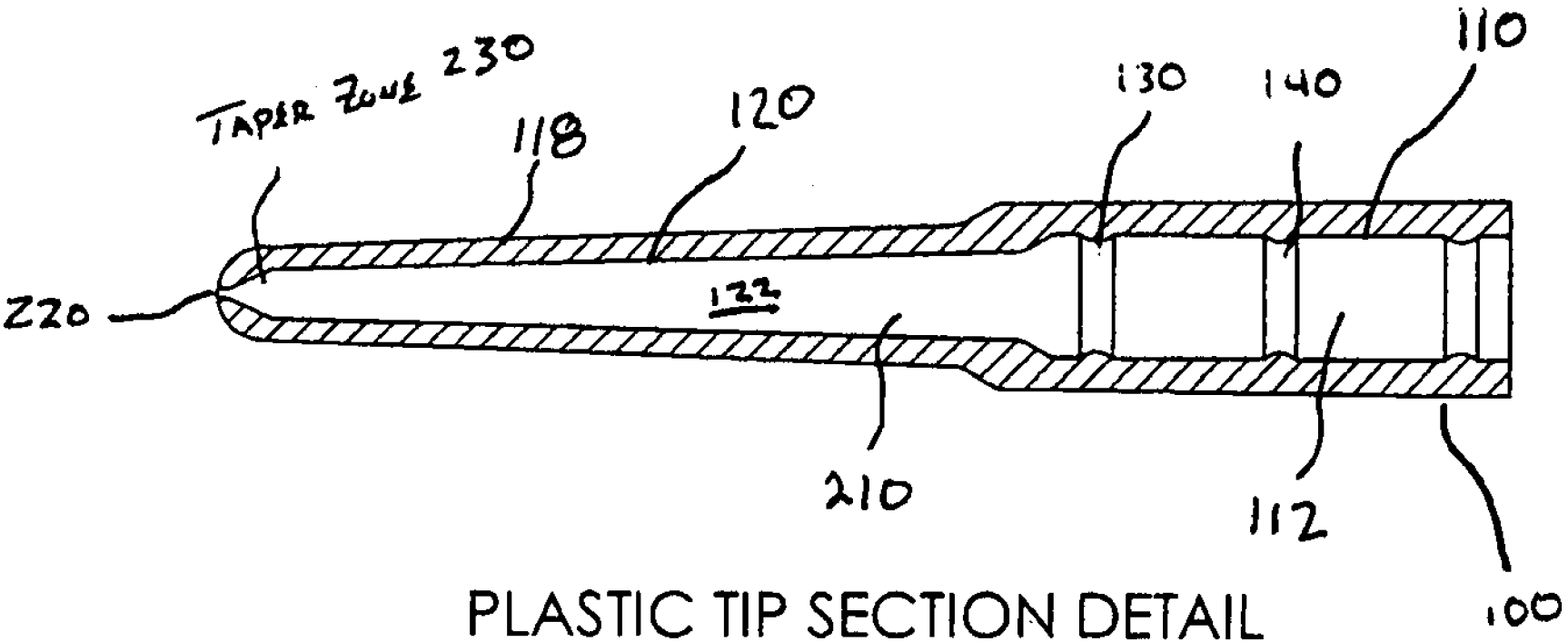
FIG. 1 is a cross-sectional view of one embodiment of the fluid dispensing device of the present invention.

FIG. 1 is a cross sectional view of one embodiment of an optimally shaped device (tip) 100 that can be attached to the discharge end of the fluid reservoir component of a fluid dispenser. The tip 100 comprises two regions, a first region (sleeve) 110 including body 118, an interior cavity 112, and nibs 130, 140; and a second region 120 including body 118, and a lumen 122 that comprises a sample cavity 210, an orifice 220, and a taper zone 230.

Figure 3:
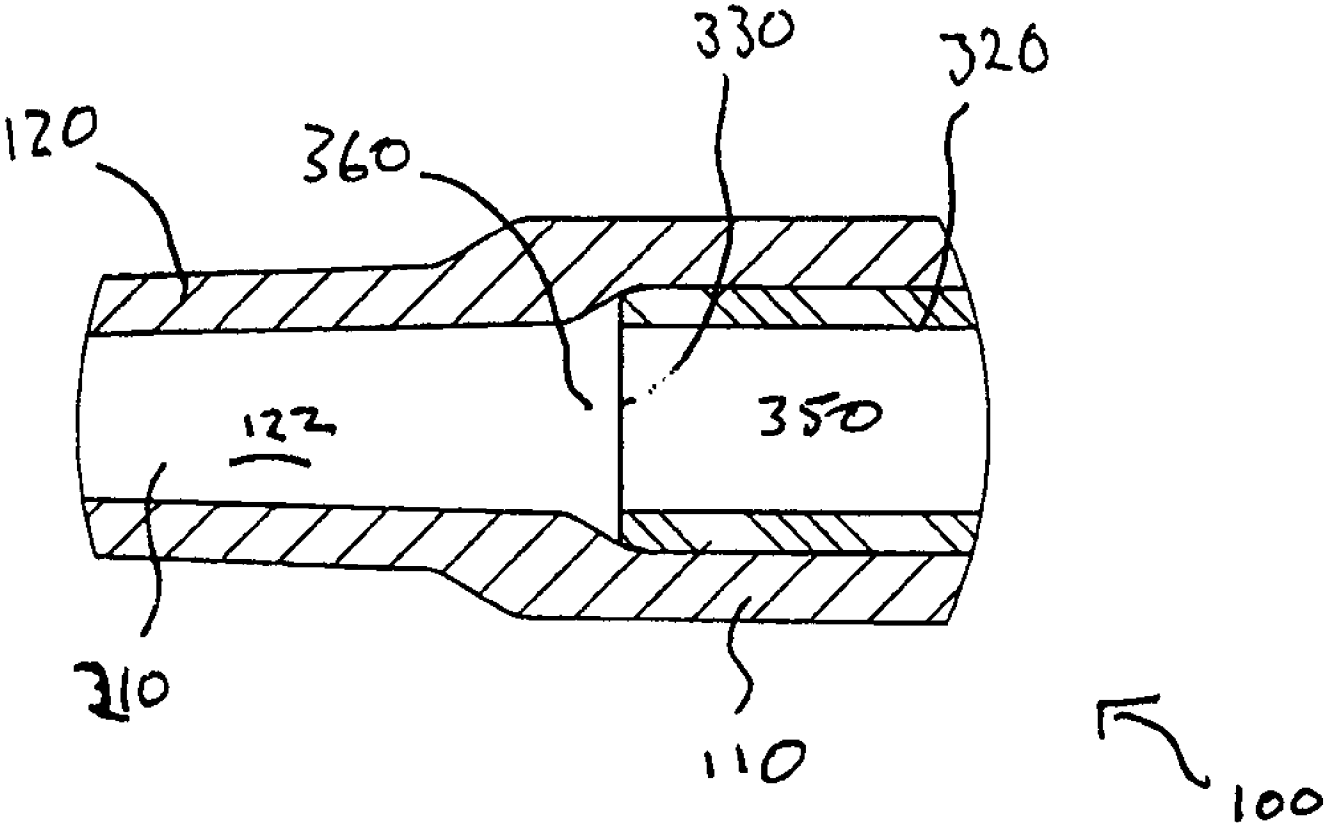
FIG. 3 is a cross-sectional view of the transition from tip to fluid reservoir in certain embodiments of the present invention.
Figure 4:
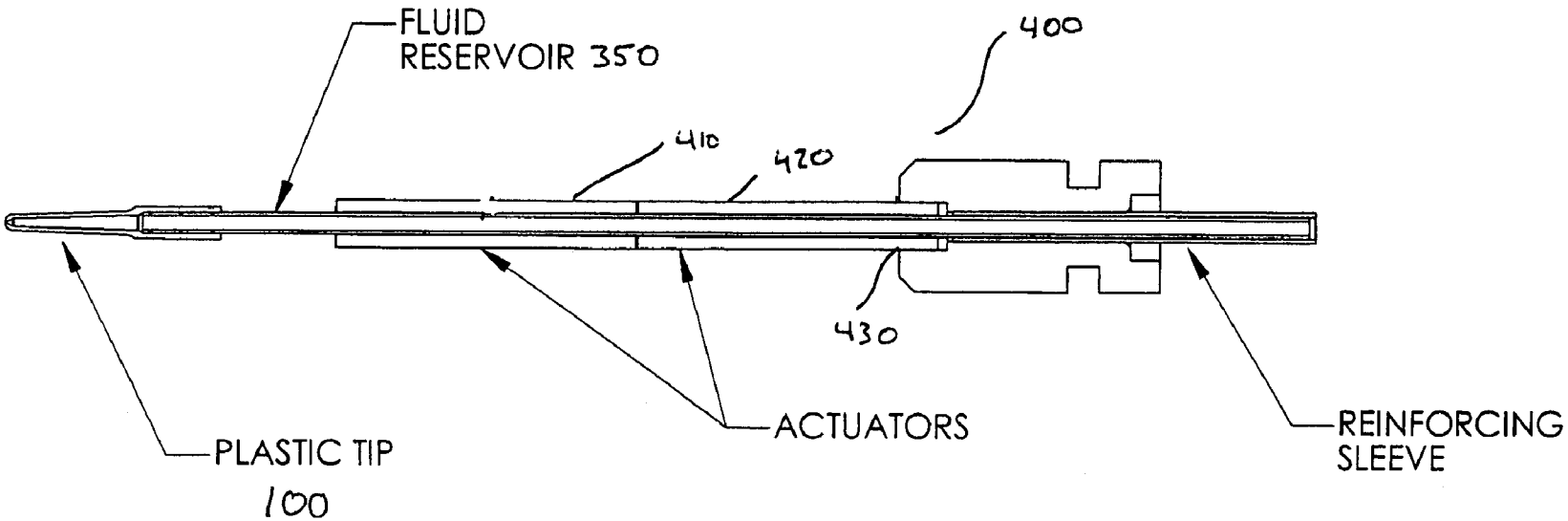
FIG. 4 is a depiction of one embodiment of a liquid dispensing system according to the present invention.

The interior cavity 112 of the first region 110 can accommodate the discharge end 330 of a cylindrically shaped liquid-filled tube 320 of a dispenser 400 (see FIGS. 3 and 4). In one embodiment, the inner diameter of the first region 110 is greater than the outer diameter of the tube 320, so that it serves as a sleeve. At the end of the first region 110, proximate the tube 320, the inner diameter of the first region 110 may decrease over a short longitudinal distance to provide a stop when the tube 320 is inserted into the first region 110. The first region 110 may contain at least two circular nibs 130, 140 that extend circumferentially around the entire inner surface of the first region 110. The radial extent of each nib 130, 140 away from the inner surface of the first region 110 is matched to the outer diameter of the inserted tube 320 so that the outer surface of the tube 320 is contacted. Slight compression of the nib 130, 140 material may ensure that a tight grip of the tube 320 by the tip 100 is maintained after the tube 320 is inserted into the first region 110. Multiple nibs 130, 140 may ensure that the longitudinal axis of the liquid-filled tube 320 is coincident with that of the tip 100.

Figure 2:
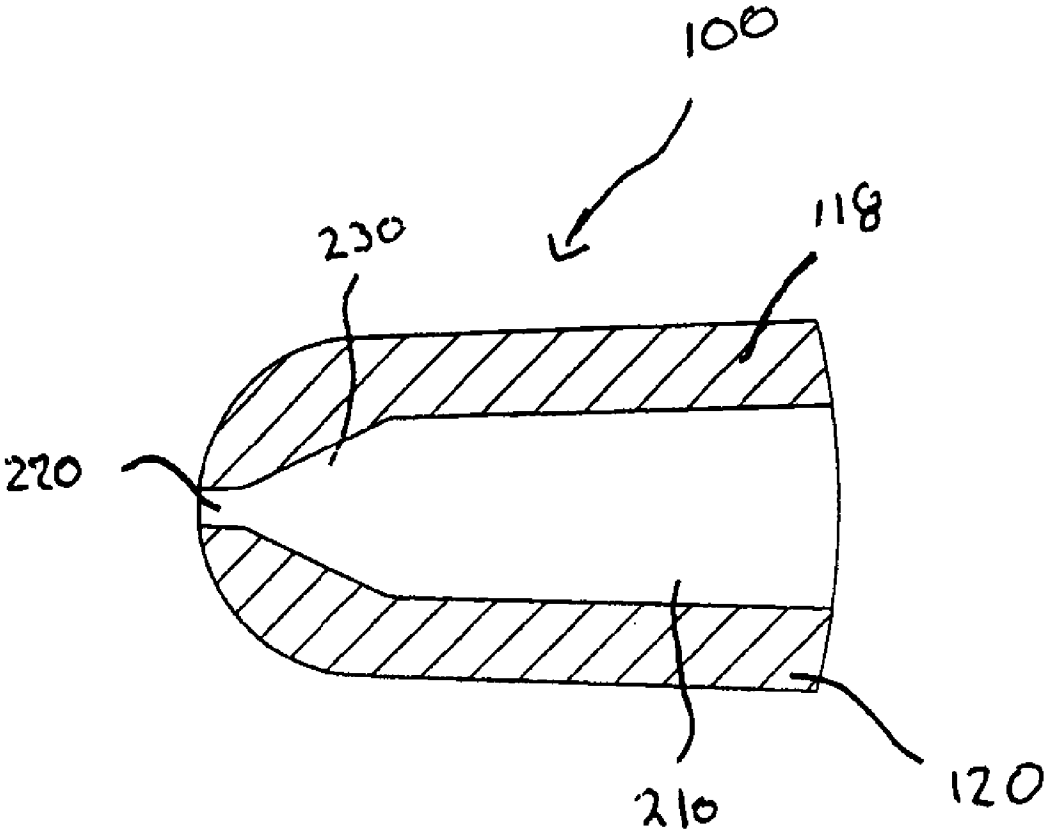
FIG. 2 is a cross-sectional close up of an orifice and taper zone for an embodiment of the present invention.

FIG. 2 is a cross-sectional close up of the portion of the second region 120 of FIG. 1. The lumen 122 of the second region 120 contains a taper zone 230 where the diameter of the lumen 122 decreases from the sample cavity 210 to the orifice 220. In typical sub-nanoliter dispensing operations, the diameter of the orifice 220 is on the order of 80 μm, so as to produce ejected drops with volumes on the order of 500 pL. As is known to those skilled in the art, the diameter of the orifice 220 may be selected to enable dispensing of drops with larger or smaller volumes.

When one progresses away from the orifice 220 and toward the sample cavity 210 along the longitudinal axis of the second region 120 (within the taper zone 230), the diameter of the lumen 122 may increase at the gradient required to achieve the taper angle needed for propagation of an actuation pressure to the orifice 220 to produce a substantially uniform droplet size of liquid out of the orifice 220. The length of this tapered region 230 and the diameter of the lumen 122 where it joins the sample cavity 210 are determined by the angle of the taper desired. The optimal angle between the longitudinal axis of the sample cavity 210 and the wall of the lumen 122 in the region where the lumen 122 radius decreases can be determined through an analytical solution of Navier-Stokes equations for a nozzle in oblate spheroidal coordinates. Such a solution indicates that the taper angle that maximizes the longitudinal component of the pressure nearest the orifice 220 is approximately 41.4 degrees of arc. As will be understood by those skilled in the art, this taper angle can vary to have higher or lower degrees of arc, including taper angles ranging from forty degrees to forty-three degrees, or even taper angles ranging from twenty-five degrees to sixty-seven degrees (see, for example, FIG. 7).

Figure 7:
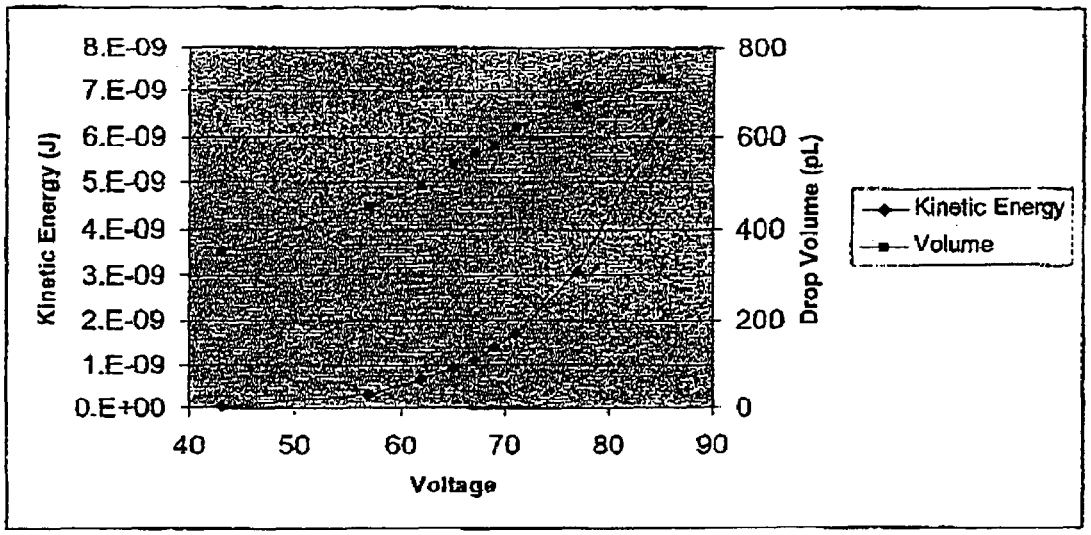
FIG. 7 is a graph of the control of drop volume by stimulus amplitude for certain other embodiments of the present invention.

In one embodiment in which the taper angle of the wall is 41.4 degrees of arc, the length of this taper zone is 0.5 mm. This requires that the lumen diameter taper with a gradient of −0.8816 mm over the longitudinal length of 0.5 mm. For an 80 μm diameter orifice 220, the lumenal diameter where the taper zone 230 meets the sample cavity 210 is 0.9616 mm to accommodate the dimensions. The taper angle of the taper zone 230 may be less or more according to need (e.g., 25 degrees of arc as shown in FIG. 7).

FIG. 3 shows the junction 360 between the first region 110 and the second region 120 for the tip 100. The sample cavity 210 is configured to contain the requisite volume of sample that will be dispensed. The lumenal diameter of the sample cavity 210 may be constant along the longitudinal axis, or it may gradually change from the junction 360 between the sample cavity 210 and the first region 110, to where the taper zone 230 near the orifice 220 meets the sample cavity 210. In the preferred embodiment, junction 360 between the first region 110 and the sample cavity 210 is tapered so that the diameter of the sample cavity 210 is identical (or approximately so) to that of the fluid reservoir 350 where the dispense is actuated. This enables the actuation pressure wave generated in the liquid by the actuation event to propagate from the fluid reservoir tube 320 into the sample cavity 210 with little or no decrement possibly caused by an area dilation of the liquid pathway at the junction 360 between where the liquid-filled tube 320 is inserted in the first region 110 and the point where the tube 320 and the sample cavity 210 are joined.

In the preferred embodiment, the length and diameter of the sample cavity 210 are selected so that a desired volume of sample can be aspirated through the orifice 220 and then repeatedly dispensed, drop by drop, to a large number of sample destinations. For a sample cavity 210 length of 9 mm and a sample cavity 210 diameter of 0.8 mm, the resulting 4.5 pL volume is sufficient for ejecting 22,000 drops each 500 pL in volume.

The tip 100 may be designed to slip over the discharge end 330 of the liquid filled tube 320 to which actuators are coupled. In the preferred embodiment, the fluid reservoir tube 320 is a quartz microcapillary of 73 mm length, an outer diameter of 1.0 mm and an inner diameter of 0.8 mm. The tube 320 may be filled with a system liquid that serves to propagate the actuation pressure wave generated by the actuator to the sample maintained behind the orifice 220. It is well appreciated by those skilled in the art that a major problem with liquid chemical reagent dispensing is contamination of a dispenser 400 by carryover of remnants of previously dispensed samples in the parts of the dispenser 400 exposed to the samples.

Embodiments of this invention obviate this problem with liquid dispensing because the tip 100 may slip on to the main fluid reservoir tube 320. The sample cavity 210 can be filled with liquid from the main tube 320 and then the sample aspirated from the sample cavity 210 through the orifice 220 from an external source of sample. Then the sample can be dispensed. Since the system liquid that comes into contact with the sample was pushed into the slip-on tip 100, contaminated system liquid remains in either the sample cavity 210, or in the junction region 360 between the sample cavity 210 and the first region 110. In either case, the contaminated system liquid is removed when the tip 100 is slipped off the main tube 320. Since the sample is never introduced into the main tube 320 but only into slipped-on the tip 100, the invention avoids carryover contamination between different samples dispensed by the dispenser 400.

With reference to FIG. 1, the slip-on feature may be accommodated by the nibs 130, 140 that protrude into the internal cavity 112 of the first region 110 into which the discharge end 330 of the tube 320 is inserted. In the preferred embodiment, the nibs 130, 140 are cylindrical in shape to fit completely around and contact the inserted tube 320. Although the inner diameter of the first region 110 may be greater than the outer diameter of the tube 320 in order to facilitate insertion, each nib 130, 140 protrudes into the internal cavity 112 of the first region 110 so that the inner diameter of each nib 130, 140 is slightly smaller than the outside diameter of the tube 320. The nibs 130, 140 may be compressible so that insertion of the tube 320 presses each nib 130, 140 radially and achieves an expansive seal between the nib 130, 140 and the outer surface of the tube 320. Thus, each dispenser 400 can be assembled by pressing the tube 320 into the first region 110 of the tip 100. During dispensing operation, the removal of a used tip 100 and the attachment of a fresh unused tip 100 can be automated for a large array of multiple dispensers.

It will be appreciated by those skilled in the art that a wide variety of material can be used for the construction of the dispenser tip 100 described. The same materials used for the liquid-holding tube 320 of dispenser 400 can be used for the tip 100. Fabrication of a large number of identical tips 100 at reasonable expense and with reasonable ease is achieved by molding the tip 100 into the described design with plastics. These include thermoplastics such as polyethylenes, polypropylenes, cyclo-olefins, polymethylpentenes as well as thermosetting plastics such as fluoroethylenes, polyetheretherketones (PEEK), and polycarbonates, in addition to ceramic materials such as alumina, glass, and quartz that can be melted to low viscosity and then injected into a mold of the tip 100 design. The choice of materials is determined by both the desired structural rigidity of the tip 100 and the required resistance to chemicals.

In one preferred embodiment, the tip 100 is fabricated from injection-molded PEEK. This plastic maintains structural rigidity even at the narrow diameter of the tip 100 in the vicinity of the orifice 220. The rigidity is important for automated location and placement of the tip 100 into external reservoirs of sample liquid that are miniaturized and may have cross-sectional diameters on the order of 1 mm. The rigid material of the tip 100 prevents the development of bends along the tip 100. Furthermore, PEEK is resistant to dimethylsulfoxide, the most common diluent liquid used for storage of concentrates of organic chemical compounds which are samples used for drug discovery.

In another embodiment, the tip 100 is manufactured from polypropylene, which is advantageous for the purpose of injection molding. In addition to its resistance to organic solvent, the mechanical compliance of polypropylene enables the first region 110 of the tip 100 to expand when the liquid-carrying tube 320 is inserted, and its elasticity ensures that a tight, liquid-impermeable seal is formed between the microcapillary and the tip 100 to prevent the unwanted loss of either system liquid present in the tube 320, or sample that is drawn up into the tip 100 past the sample cavity 210. It should be understood, however, that other plastics may be used because of desirable characteristics such as cost, or wettability or non-wettability of the sample liquid.

FIG. 4 shows one embodiment of the fluid microdispenser 400 with the slip-on tip 100. The microcapillary tube 320 is inserted into the first region 110 of the tip 100, as shown in FIG. 3. Actuators 410, 420 may be two (or more) annular, radially polled piezoelectric elements of the piezoelectric material PZT-5A obtained from Morgan Electroceramics Co. The end of the actuator 410 nearest the tip 100 can be positioned approximately 16 mm away from the tip 100 so that the tip 100 can be submerged into liquid without compromising the electrical actuation of dispensing by inadvertent wetting of the portion of the tip 100 not submerged in chemical sample. Electrification may be achieved by known means, such as a thin deposition of nickel metal on the entire outer and inner surfaces of each cylinder. These metal layers serve as electrodes, and are connected to an external driver circuit that delivers a voltage pulse for actuation of dispensing. The inner deposition layer is continuous across one of the cut ends of each cylinder and so joins an approximately 3 mm length of the outer surface that is in electrical continuity with the inner surface. This electrode is separated from the remainder of the outer surface by a non-electrically conductive ceramic ring embedded in the piezo material in order to isolate the outer and inner electrodes.

At the opposite cut end 430 of the tube cylinder, a cut is made so as to physically separate the outer and inner depositions of metal. The portion of the inner electrode, in continuity with the small outer portion of the surface, serves to enable electrical connection between the inner electrode and the external driver. The two piezo cylinders are brought into abutment with each other at their respective ends where the metal deposition is continuous between the outer and inner surfaces. To actuate dispensing, the positive-going electrical pulse from the driver circuit is applied so that the inner electrode is the anode (positive sign of voltage with respect to the outer electrode). This causes the annular piezo to thicken so that its inner radius decreases and it compresses the fluid reservoir 350.

Figure 5:
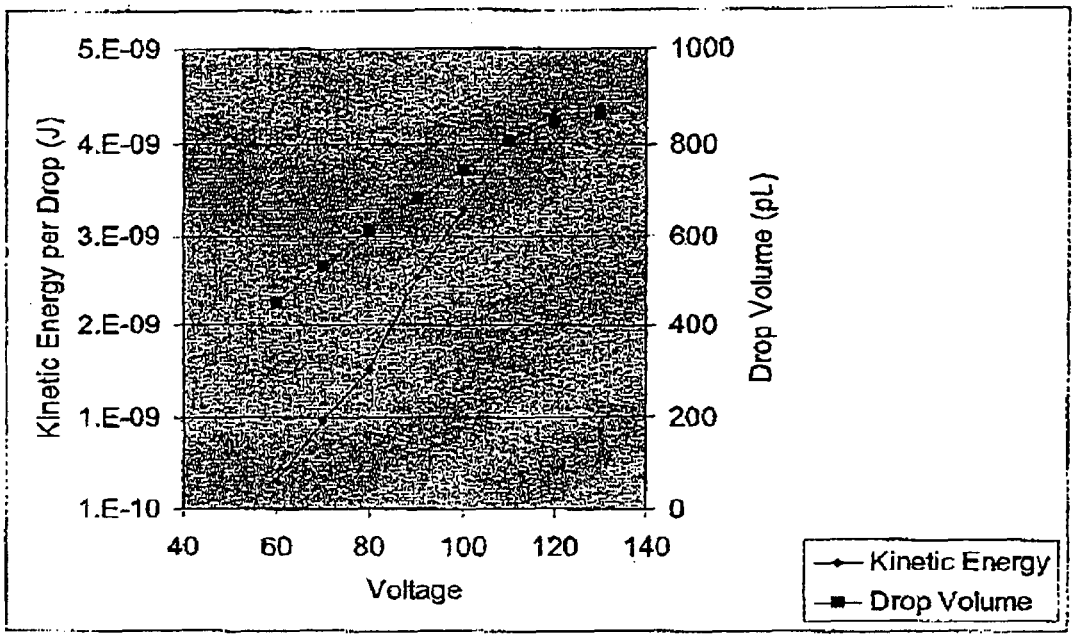
FIG. 5 is a graph of the control of drop volume by stimulus amplitude for certain embodiments of the present invention.

FIG. 5 is a graph stating, the control of drop volume by stimulus amplitude is shown for a fluid microdispenser 400 fabricated with an embodiment of the slip-on tip 100 of the present invention. To aid in judgment of the overall ability of the dispenser 400 to transduce the mechanical energy imparted by actuation into fluid movement, the kinetic energy of the single drop ejected by the stimulus is superimposed on the figure. The stimulus pulse was a shaped square wave that increased to the maximum voltage amplitude shown at a rate of 3.5V/p. The pulse dwelled at this voltage for a total time of 0.5 msec, and then declined with an exponential time constant of 1.2 msec.

Figure 6:
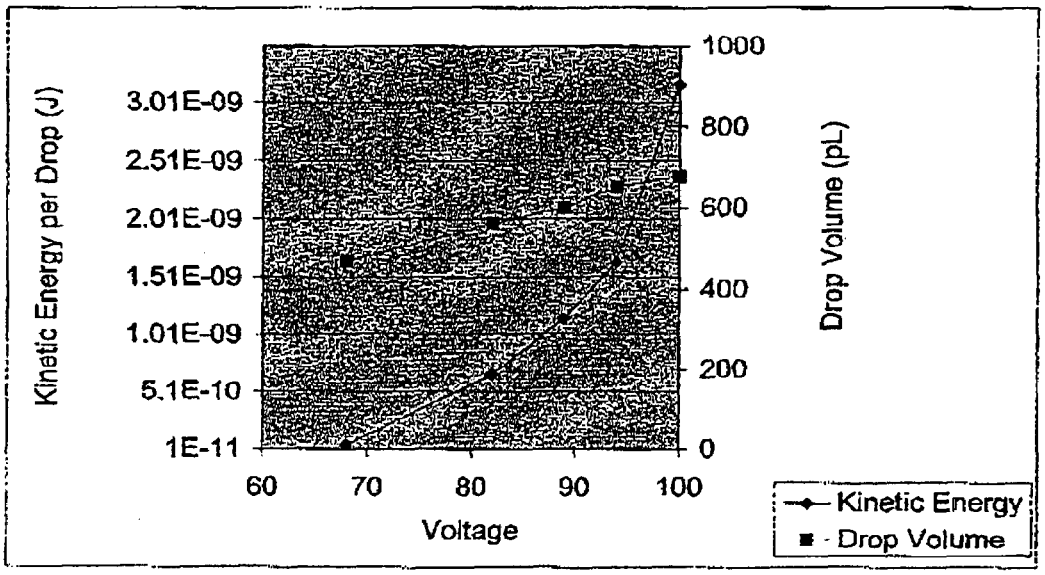
FIG. 6 is a graph of the control of drop volume by stimulus amplitude for certain prior art systems.

For comparison, the same relations in FIG. 6 are shown for a prior art microdispenser without the slip-on tip 100 and controlled taper of the present invention. The end of a glass microcapillary was heated and drawn to a tip with an orifice diameter of 80 μm. It can be seen that the slip-on tip 100 of embodiments of the present invention provides twice as much change in volume for an equal change in stimulus voltage as the drawn tip with the uncontrolled taper.

FIG. 7 is a graph illustrating dispensing results for another embodiment of the present invention having a tip 100 where the taper was fabricated by chamfering the flat end of a microcapillary having an inner diameter of 0.08 mm and an outer diameter of 0.8 mm with a carbon dioxide laser beam into a V-shaped taper with taper angle of 42 degrees of arc. The chamfered end was inserted 0.5 mm into the open end of a 0.8 mm inner diameter microcapillary and then fused by heating with a laser beam the entire circumference of the region where the insert was in contact with the outer glass sleeve. This embodiment exhibits dispensing at lower voltages relative to the other two, and exhibits approximately the same gain of drop volume with stimulus voltage as the slip-on tip 100 with the 25 degree taper.

Figure 8:
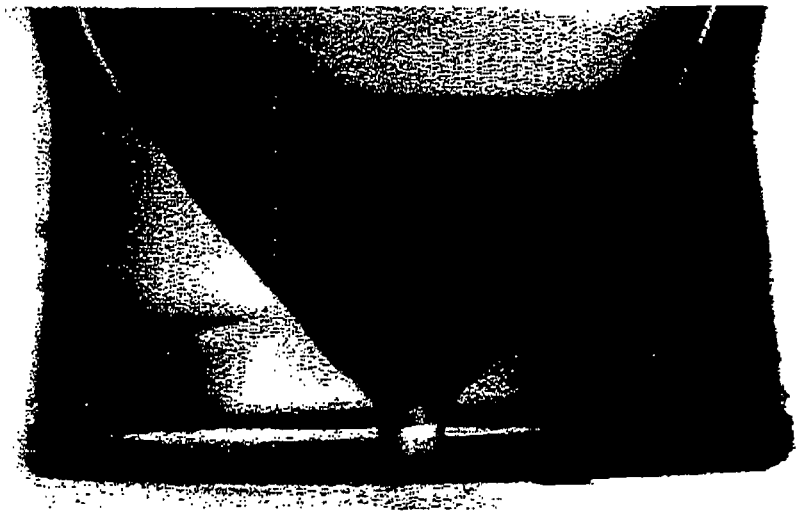
FIG. 8 is a micrograph of certain embodiment of the present invention fabricated by an insert-fusion method of controlling the taper to the orifice.

FIG. 8 is a micrograph of the tip 100 of FIG. 7 fabricated by this insert-fusion method of controlling the taper to the orifice 220.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A tip for dispensing droplets of fluid, comprising:

an orifice;

a first region operable to accommodate a discharge end of a fluid reservoir, the first region including a stop and two or more circular nibs extending circumferentially inward from an inner surface of the first region to engage and secure the first region to the discharge end of the fluid reservoir; and a second region between the first region and the orifice further comprising a lumen, the lumen having a taper zone wherein the lumen tapers to the orifice at a taper angle that propagates an actuation pressure to the orifice to produce a substantially uniform drop size.

2. The apparatus of claim 1, wherein the taper angle is between approximately 25 degrees and approximately 67 degrees.

3. The apparatus of claim 1, wherein the taper angle is between approximately 40 and approximately 43 degrees.

4. The apparatus of claim 1, wherein the taper angle maximizes the longitudinal component of the actuation pressure at the orifice.

5. The apparatus of claim 1, wherein the taper angle is approximately 41.4 degrees.

6. The apparatus of claim 5, wherein the orifice is 80 μm.

7. The apparatus of claim 6, wherein the lumen tapers with a gradient of −0.8816 mm over a longitudinal length of 0.5 mm.

8. The apparatus of claim 7, wherein the discharge end of the fluid reservoir is a quartz microcapillary of 73 mm length, an outer diameter of 1.0 mm, and an inner diameter of 0.8 mm.

9. The apparatus of claim 1, wherein the tip is detachable from the fluid reservoir.

10. The apparatus of claim 9, wherein the first region slips onto the discharge end.

11. The apparatus of claim 1, wherein the diameter of the end of the lumen distal from the orifice is approximately the same diameter as the discharge end.

12. The apparatus of claim 1, wherein the second region is operable to contain a defined volume of liquid to be dispensed.

13. The apparatus of claim 1, wherein the lumen is either a constant diameter between the first region and the taper zone or is tapered between the first region and the taper zone.

14. The apparatus of claim 1, wherein the tip is fabricated from injection-molded polyetheretherketones, polyethylene, cyclo-olefin copolymers or polypropylene.

15. The apparatus of claim 1 fabricated using an insert-fusion method to control the taper angle.

16. A fluid microdispenser for dispensing a liquid, comprising:

a fluid reservoir having a discharge end;

two or more annular, radially polled piezoelectric actuators surrounding a portion of the fluid reservoir; and a tip, wherein the tip further comprises an orifice;

a first region operable to accommodate the discharge end of the fluid reservoir, the first region including a stop and two or more circular nibs extending circumferentially inward from an inner surface of the first region to engage and secure the first region to the discharge end of the fluid reservoir; and a second region between the first region and the orifice further comprising a lumen, the lumen having a taper zone wherein the lumen tapers to the orifice at a taper angle that propagates an actuation pressure to the orifice to produce a substantially uniform drop size.

17. The system of claim 16, wherein the taper angle is between approximately 25 and approximately 67 degrees.

18. The system of claim 16, wherein the taper angle is between approximately 40 degrees and approximately 43 degrees.

19. The system of claim 16, wherein the taper angle maximizes the longitudinal component of the actuation pressure at the orifice.

20. The system of claim 19, wherein the taper angle is approximately 41.4 degrees.

21. The system of claim 20, wherein the orifice is 80 μm.

22. The system of claim 21, wherein the lumen tapers with a gradient of −0.8816 mm over a longitudinal length of 0.5 mm.

23. The system of claim 22, wherein the discharge end of the fluid reservoir is a quartz microcapillary of 73 mm length, an outer diameter of 1.0 mm, and an inner diameter of 0.8 mm.

24. The system of claim 16, wherein the tip is detachable from the fluid reservoir.

25. The system of claim 24, wherein the first region slips onto the discharge end.

26. The system of claim 16, wherein the diameter of the end of the lumen distal from the orifice is approximately the same diameter as the discharge ends.

27. The system of claim 16, wherein the second region is operable to contain a defined volume of liquid to be dispensed.

28. The system of claim 16, wherein the lumen is either a constant diameter between the first region and the taper zone or is tapered between the first region and the taper zone.

29. The system of claim 16, wherein the tip is fabricated from injection-molded polyetheretherketones, polyethylene, cyclo-olefin copolymers or polypropylene.

30. A method for dispensing a liquid, comprising:

applying an actuation pressure to a fluid reservoir having a discharge end using two or more annular, radially polled piezoelectric actuators surrounding a portion of the fluid reservoir;

propagating the actuation pressure to a sample contained in a tip having a lumen, the tip including a first region having a stop and two or more circular nibs extending circumferentially inward from an inner surface of the first region to engage and secure the first region to the discharge end of the fluid reservoir;

propelling the sample through a lumen having a taper zone wherein the lumen tapers to an orifice at a taper angle that propagates an actuation pressure to the orifice to produce a substantially uniform drop size; and dispensing a desired volume of the sample through the orifice.

31. The method of claim 30, wherein the taper angle is between approximately 25 and approximately 67 degrees.

32. The method of claim 30, wherein the taper angle is between approximately 40 and approximately 43 degrees.

33. The method of claim 30, wherein the taper angle maximizes the longitudinal component of the actuation pressure at the orifice.

34. The method of claim 33, wherein the taper angle is approximately 41.4 degrees.

35. The method of claim 34, wherein the orifice is 80 μm.

36. The method of claim 30, wherein the lumen tapers with a gradient of −0.8816 mm over a longitudinal length of 0.5 mm.

37. The method of claim 36, wherein the discharge end of the fluid reservoir is a quartz microcapillary of 73 mm length, an outer diameter of 1.0 mm, and an inner diameter of 0.8 mm.

38. The method of claim 30, wherein the tip is detachable from the fluid reservoir.

39. The method of claim 38, wherein the first region slips onto the discharge end.

40. The method of claim 30, wherein the diameter of the end of the lumen distal from the orifice is approximately as the diameter of the discharge end.

41. The method of claim 30, wherein the tip includes a second region that is operable to contain a defined volume of liquid to be dispensed.

42. The method of claim 30, wherein the lumen taper zone is a constant diameter.

43. The method of claim 30, wherein the tip is fabricated from injection-molded polyetheretherketones, polyethylene, cyclo-olefin copolymers or polypropylene.

* * * * *

UNITED STATES PATENT AND TRADEMARK OFFICE

CERTIFICATE OF CORRECTION

PATENT NO. : 7,258,253 B2
APPLICATION NO. : 10/837221
DATED : August 21, 2007
INVENTOR(S) : Nicol et al.

It is certified that error appears in the above-identified patent and that said Letters Patent is hereby corrected as shown below:

TITLE PAGE

(75) After Peter J. Coassin, Encinitas, CA (US)

Insert ; Walter D. Niles, La Jolla, CA (US)

Signed and Sealed this

Eighth Day of July, 2008

JON W. DUDAS
*Director of the United States Patent and Trademark Office*